US009635955B2

(12) United States Patent
Greger

(10) Patent No.: US 9,635,955 B2
(45) Date of Patent: May 2, 2017

(54) MULTI-MODE HIGH CHAIR

(71) Applicant: ARTSANA USA, INC., Lancaster, PA (US)

(72) Inventor: Jeff G. Greger, Lititz, PA (US)

(73) Assignee: ARTSANA USA, INC., Lancaster, PA (US)

( * ) Notice: Subject to any disclaimer, the term of this patent is extended or adjusted under 35 U.S.C. 154(b) by 87 days.

(21) Appl. No.: 14/725,709

(22) Filed: May 29, 2015

(65) Prior Publication Data

US 2015/0359354 A1 Dec. 17, 2015

Related U.S. Application Data

(60) Provisional application No. 62/011,102, filed on Jun. 12, 2014.

(51) Int. Cl.
*A47D 1/00* (2006.01)
*A47D 1/10* (2006.01)

(52) U.S. Cl.
CPC ..... *A47D 1/008* (2013.01); *A47D 1/004* (2013.01); *A47D 1/10* (2013.01)

(58) Field of Classification Search
CPC ..... A47D 1/00; A47D 1/08; A47D 1/006
See application file for complete search history.

(56) References Cited

U.S. PATENT DOCUMENTS

| | | | | |
|---|---|---|---|---|
| 3,290,050 | A * | 12/1966 | Ezquerra | A47C 7/006 280/30 |
| 4,968,092 | A | 11/1990 | Giambrone | |
| 5,806,922 | A | 9/1998 | Mendelovich | |
| 5,951,102 | A | 9/1999 | Poulson et al. | |
| 6,619,734 | B2 | 9/2003 | Helmsderfer | |
| 7,878,584 | B2 | 2/2011 | Hu et al. | |
| 7,918,497 | B2 | 4/2011 | Keegan | |
| 8,091,965 | B2 * | 1/2012 | Flannery | A47D 1/103 297/250.1 |
| 8,162,390 | B2 | 4/2012 | Zhong | |
| 8,215,713 | B2 | 7/2012 | Fiore, Jr. et al. | |
| 8,256,833 | B2 | 9/2012 | Hu et al. | |
| 8,308,229 | B2 | 11/2012 | Galley | |
| 8,388,063 | B2 | 3/2013 | Fiore, Jr. et al. | |
| 8,567,867 | B2 | 10/2013 | Arnold, IV et al. | |
| 8,646,838 | B2 | 2/2014 | Fiore, Jr. et al. | |
| 9,469,222 | B2 * | 10/2016 | Williams | B60N 2/2821 |
| 2009/0039692 | A1 * | 2/2009 | Tuckey | A47D 1/008 297/344.22 |

(Continued)

*Primary Examiner* — Timothy J Brindley
(74) *Attorney, Agent, or Firm* — Patent Law Associates

(57) ABSTRACT

A multi-mode high chair for a child that may be alternatively configured as a high chair, a toddler chair, or a booster seat. The high chair comprises a toddler chair on which is nestingly mounted a booster seat to define a high chair configuration. An easily operable latch mechanism secures the booster seat to the toddler seat to retain the chair in the high chair configuration. The latch is easily and conveniently operable to enable the booster seat to be removed from the toddler chair to convert the high chair into a toddler chair and a separate booster seat. Folding feet on the booster seat allow it to stably rest on a chair or the like. A tray selectively attachable to the booster seat and an adjustable footrest add further utility to the high chair.

22 Claims, 11 Drawing Sheets

(56) References Cited

U.S. PATENT DOCUMENTS

| | | | | |
|---|---|---|---|---|
| 2011/0193390 | A1* | 8/2011 | Hsiao | B60N 2/146 297/344.22 |
| 2011/0227384 | A1 | 9/2011 | Huntsberger et al. | |
| 2013/0241248 | A1 | 9/2013 | Kostyniak et al. | |
| 2014/0292050 | A1* | 10/2014 | Chen | A47C 4/02 297/256.16 |
| 2014/0368006 | A1 | 12/2014 | Taylor et al. | |
| 2014/0368014 | A1 | 12/2014 | Haut et al. | |
| 2015/0296987 | A1* | 10/2015 | Hondros | A47D 1/002 297/344.21 |
| 2016/0174727 | A1* | 6/2016 | Haut | A47D 11/002 297/130 |
| 2016/0192787 | A1* | 7/2016 | Perrin | A47D 1/006 297/16.1 |

* cited by examiner

MULTI-MODE HIGH CHAIR

CROSS REFERENCE TO RELATED APPLICATIONS

This application claims the benefit of priority of U.S. Provisional Application 62/011,102, filed Jun. 12, 2014.

BACKGROUND OF THE INVENTION

This invention relates generally to a child's high chair and, more particularly, to a multi-mode high chair capable of being configured in multiple arrangements that can be used for a longer duration of a child's early life.

Parents use different products to position their children for feeding from the time the child is an infant until the child is old enough and large enough to sit at a table properly. A high chair is typically used to support infants and small toddlers at an elevated position so that the caregiver can easily feed the child. High chairs often include a removable tray to initially provide a surface for holding food for the child in close proximity for eating. Many high chairs include adjustable legs to allow the height of the chair and tray surface above the floor to be adjusted. As the child grows, it is common for parents to remove the tray and use the high chair with its elevated seat height to position the child for eating at a traditional table. As the child continues to grow, a booster seat that is typically positioned in the seat of a standard chair to elevate the child on the chair to reach a normal table.

It is common for parents to acquire high chairs and booster seats separately as their child grows. With the myriad of other accessories dedicated to growing children, the resulting assortment of child products occupies significant space in the home or when traveling. A chair adaptable to provide seating for a child growing through the toddler years would advantageous and simplify the necessary accessories to be provided parents.

SUMMARY OF THE INVENTION

Accordingly, the present invention, in any of the embodiments described herein, may provide one or more of the following advantages:

It is an object of the present invention to provide a multi-mode high chair for a child that may be alternatively used in one of several configurations for flexibility in use. The present invention may be selectively reconfigured for use as a traditional high chair, a toddler chair, or a booster seat for use in a conventional chair.

It is another object of this invention to provide a high chair that includes a toddler chair on which is mounted a booster seat to define a high chair configuration. The booster seat portion includes a movable backrest that allows the angle of the backrest to be selectively positioned and a removable tray. The invention enables the booster seat to be removed from the toddler chair to convert the high chair into a toddler chair and a separate booster seat.

It is a further object of the present invention to provide a multi-mode high chair that includes a toddler chair configured to nest in to the underside of a booster seat with a moveable backrest to form a high chair configuration. A latching mechanism is provided to retain the booster seat portion in connection with the toddler chair portion until it is selectively released. The latching mechanism is easily assessable for quick and easy release of the booster seat portion. The mechanism is spring loaded so that attaching the booster seat to the toddler chair portion occurs automatically as the booster seat is nested atop the toddler chair.

It is a further object of the present invention to provide a multi-mode high chair that includes a removable booster seat portion that is self-supporting for use on a conventional chair. A tray may be selectively attached and the backrest angle adjusted to ideally position a child at a conventional table. The booster seat portion includes moveable feet that fold to form an enclosed compartment to conceal anchoring straps and unfold to allow access to compartment and removal of the straps and to provide a stable footing for the booster seat portion on a generally flat surface. The straps may then be used to secure the booster seat portion to the flat surface.

It is a still further object of the present invention to provide a toddler chair having an adjustable backrest. The backrest may be adjusted to that it does not interfere with nesting of the booster seat atop the toddler chair or extended to provide an appropriate-height backrest for the chair when in use as a toddler chair. The booster seat portion may also include a movable backrest. The low profile position for the toddler seat backrest is necessary to minimize spatial intrusion into the volume occupied by the booster seat backrest movement mechanism when the booster seat portion is positioned on the toddler chair.

It is a still further object of the present invention to provide a toddler chair having an adjustable footrest. The footrest may be positioned in one of a plurality of positions to provide an ideally positioned rest for a child feet whether the chair is configured as a high chair or a toddler chair.

It is a still further object of the present invention to provide a multi-mode high chair that includes a tray that is selectively removable from the booster seat portion enabling the high chair to be used in a stand-alone location or positioned adjacent to a normal dining table.

It is a still further object of the present invention to provide a multi-mode child seat configurable in multiple configurations that is durable in construction, inexpensive of manufacture, carefree of maintenance, easily assembled, and simple and effective to use.

These and other objects are achieved in accordance with the present invention by a multi-mode high chair for a child that may be alternatively configured as a high chair, a toddler chair, or a booster seat. The high chair comprises a toddler chair on which is nestingly mounted a booster seat to define a high chair configuration. An easily operable latch mechanism secures the booster seat to the toddler seat to retain the chair in the high chair configuration. The latch is easily and conveniently operable to enable the booster seat to be removed from the toddler chair to convert the high chair into a toddler chair and a separate booster seat. Folding feet on the booster seat allow it to stably rest on a chair or the like. A tray selectively attachable to the booster seat and an adjustable footrest add further utility to the high chair.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as a high chair would normally rest on a floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 2:
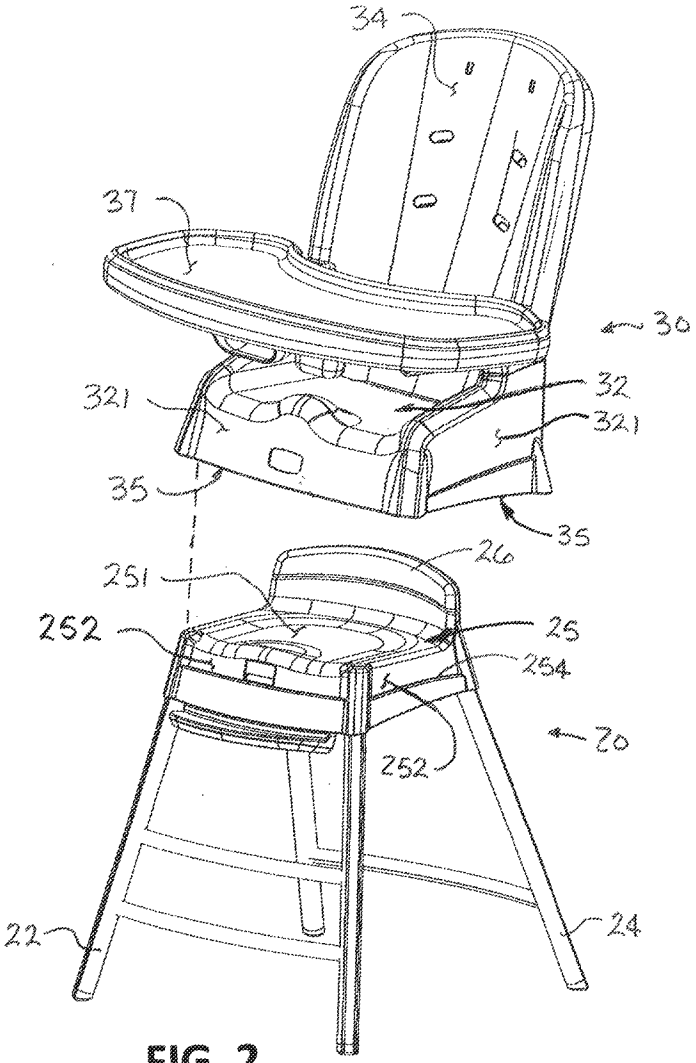
FIG. 2 is a view of the multi-mode high chair of FIG. 1 showing the booster seat portion and the toddler seat portion separated.
Figure 1:
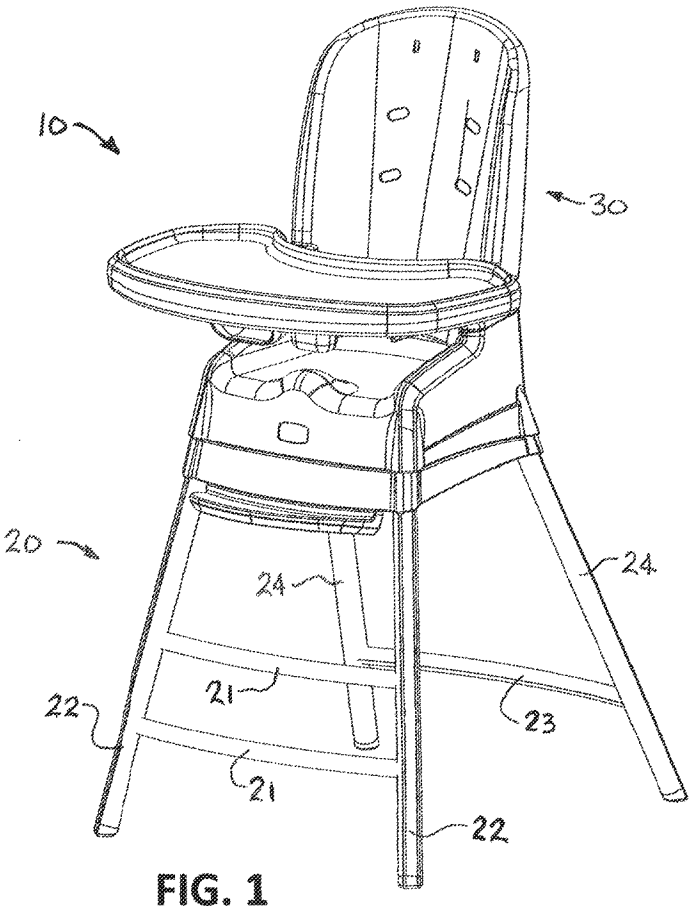
FIG. 1 is a front perspective view of a multi-mode high chair embodying the principles of the instant invention.

Referring to the figures and to FIGS. 1 and 2 in particular, a high chair 10 adaptable for use in multiple modes is shown comprising a lower seat portion 20 (toddler seat) and an upper seat portion 30 (booster seat) connected atop the lower seat portion 20 to form the composite high chair assembly. The lower seat portion 20 is supported above a surface by a plurality of upstanding legs. The advantages of the high chair 10 adaptable for use in multiple modes include a single product that can be selectively configured as a high chair (FIG. 1), a toddler chair (FIG. 4), or a booster seat for use in a conventional chair (FIG. 3).

Figure 3:
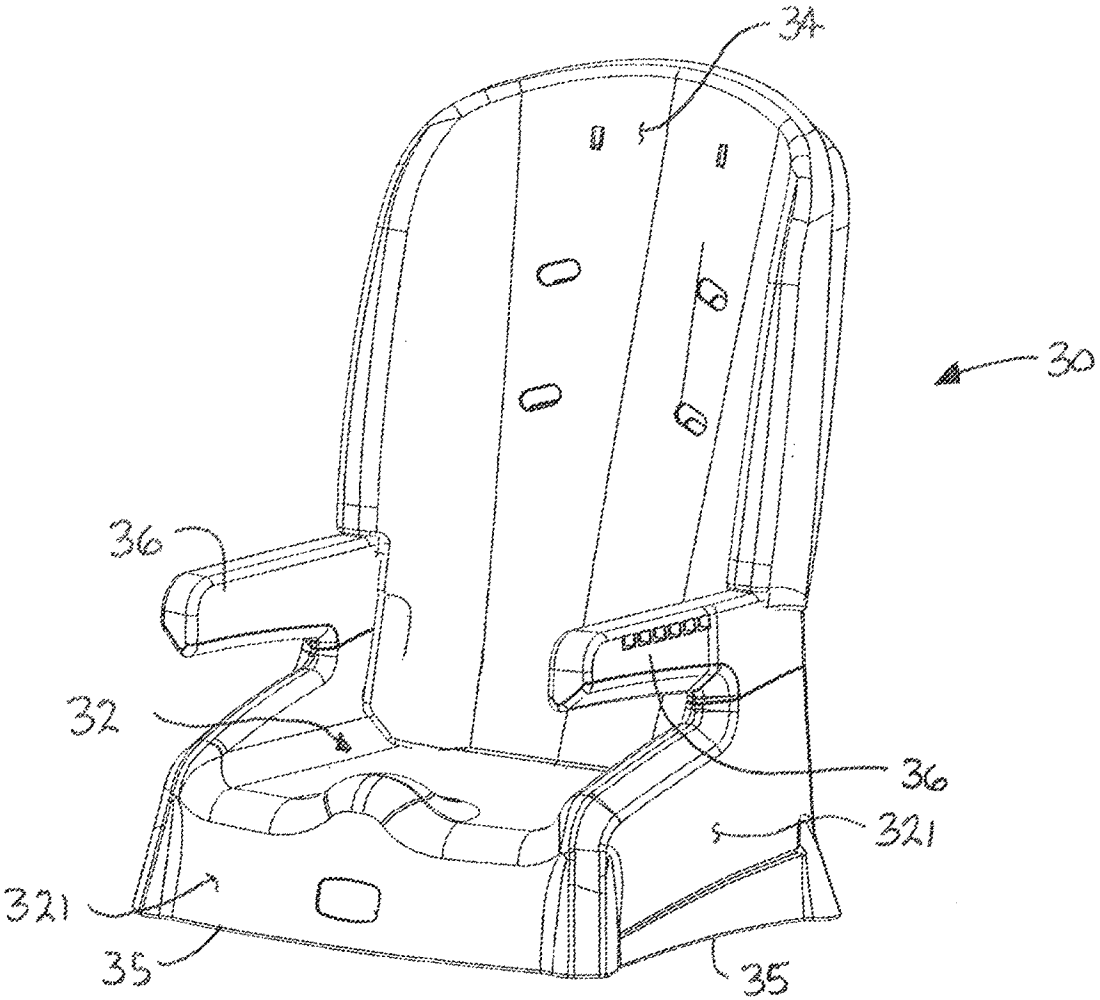
FIG. 3 is a front perspective view of the booster seat portion of FIG. 2 shown with the tray removed.
Figure 4:
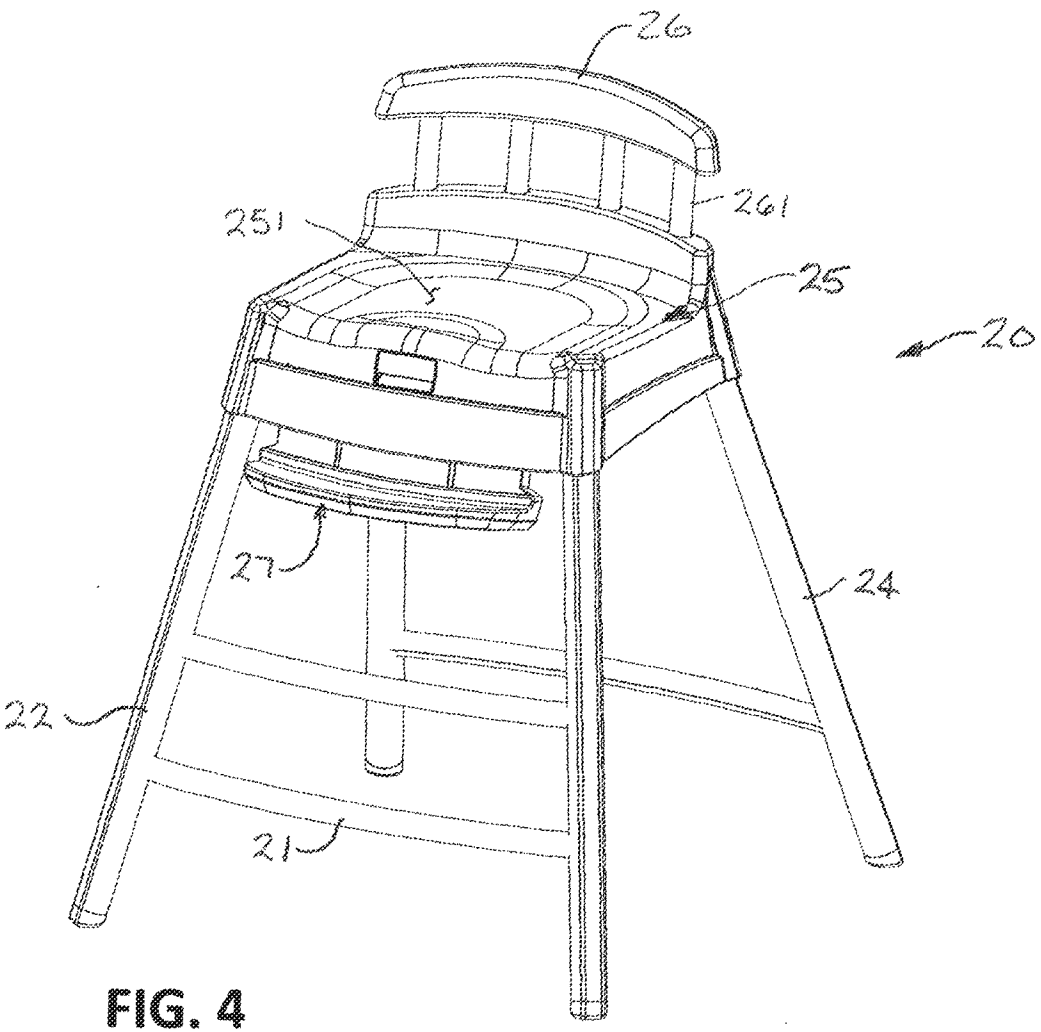
FIG. 4 is a front perspective view of the toddler seat portion of the high chair of FIG. 1 shown with footrest and backrest in the extended positions.

Referring to FIGS. 3 and 4 in connection with FIGS. 1 and 2, the lower seat portion 20 includes a pair of forwardly extending and spaced apart front legs 22 and a pair rearwardly extending rear legs 24 connected to and supporting a seat structure 25 in an elevated position above the floor or similar generally level surface. The front and rear legs are angled forwardly and rearwardly, respectively, to stably support the chair while permitting the seat structure to be reasonably sized as a seat for a child. Respective front and rear leg pairs may also be angled laterally to increase lateral stability of the chair. Stability is further enhanced by cross members 21, 23 connecting opposite side front or rear legs. Other legs configurations may be used to elevate the lower seat portion 20 above the surface.

A lower seat assembly 25 is connected to upper ends of the support legs and includes a generally horizontally arranged lower seating surface 251 and a generally upstanding back support 26 disposed along the rearward edge of the lower seating surface 251. The back support 26 includes one or more telescoping members 261 that allow the back support 26 to be vertically moved between a lowered position (FIG. 2) and a raised position (FIG. 4). The back support 26 is selectively fixable in at least the raised and lowered positions, a release allowing movement therebetween being discussed hereinafter. The lower seat assembly 25 further includes an upstandingly angled side surface 252 extending around the perimeter of the lower seat assembly for laterally restraining the upper seat assembly 30 when nestingly engaged thereon.

The booster or upper seat portion 30 includes an upper side 31 comprising a raised seating surface 32, a backrest 34, and a pair of arms 36, one on each side of the seating surface 32. The arms 36 are preferably configured to support a removable tray 37 allowing the high chair 10 to be configured for use as a high chair for a young child. The backrest 34 may be moveably connected to the upper seat portion 30 in a manner allowing the angle of the backrest in relation to the seating surface 32 to be adjusted by a user. In one embodiment, the backrest 34 is hingedly connected allowing the backrest to be selectively positioned in at least two positions. The upper side 31 terminates in a lower end 35 that extends around the lower periphery of the upper seat portion 30 and separates the exterior of the upper seat portion from a generally hollow interior space.

The interior of the upper seat portion 30 beneath the upper seat 31 is generally hollow and defines a interior recessed space 33 having an interior surface 39 configured to fit over the lower seat assembly 25 in a nesting arrangement. The interior space 33 may also include support structures 335 which contact lower seat assembly 25 when the upper seat portion is nestingly engaged on the lower seat assembly 25 to provide a means for vertically supporting the upper seat portion 30. The ends of the support structures 335 which contact the lower seat assembly are disposed within the recessed space 33, and as such do not project below the perimeter defined by the lower end 35 of the upper seat portion 30 and thus do not provide vertical support for the upper seat portion 30 when it is detached from the lower seat portion 20.

The recessed space 33 may be sufficient to nest over the lower seat structure 25 with the back support 26 in a raised position; however, it is preferable to limit volume of the interior space of the upper seat to provide for a moveable backrest which thus requires intrusion into the space 33 by the back support 26 to be minimized. Positioning the back support 26 in the lowered position before the upper seat portion 30 is nestingly engaged on the lower seat assembly 25 maintains sufficient volume in the recessed space 33 to accommodate the backrest reclining mechanism. The nesting relationship between the recessed space 33 and the lower seat assembly 25 inhibits lateral movement of the upper seat portion 30 when it is nestingly positioned on the lower seat assembly 25 and in contact therewith to vertically support the upper seat portion 30.

Figure 5:
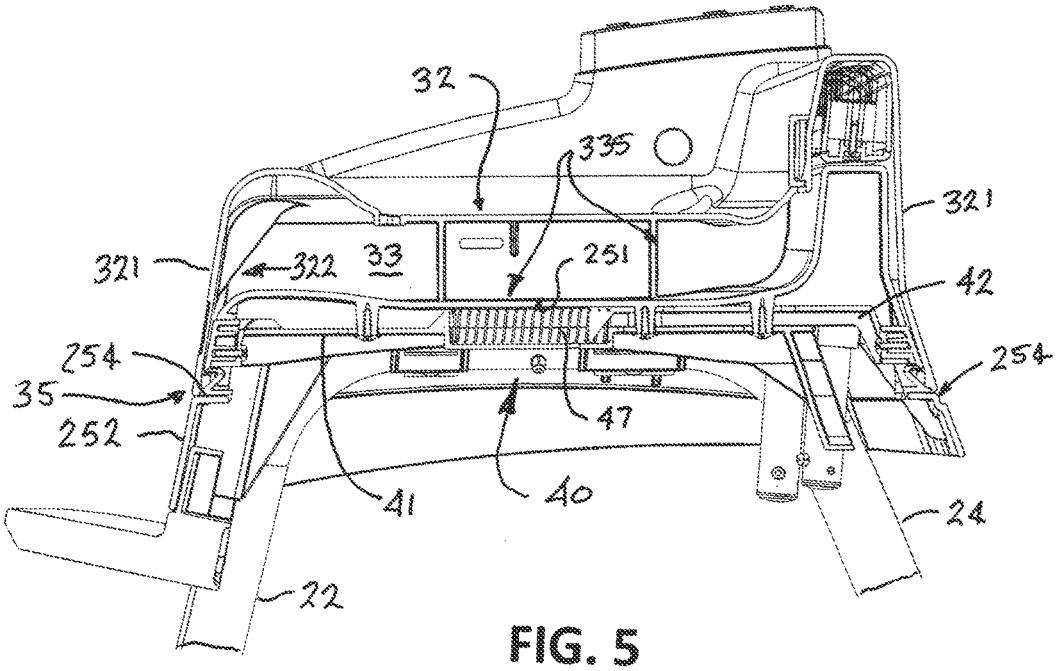
FIG. 5 is a section view of the chair of FIG. 1 showing the nesting arrangement of the booster seat portion and the toddler seat portion and a latching mechanism in the latched position.
Figure 6:
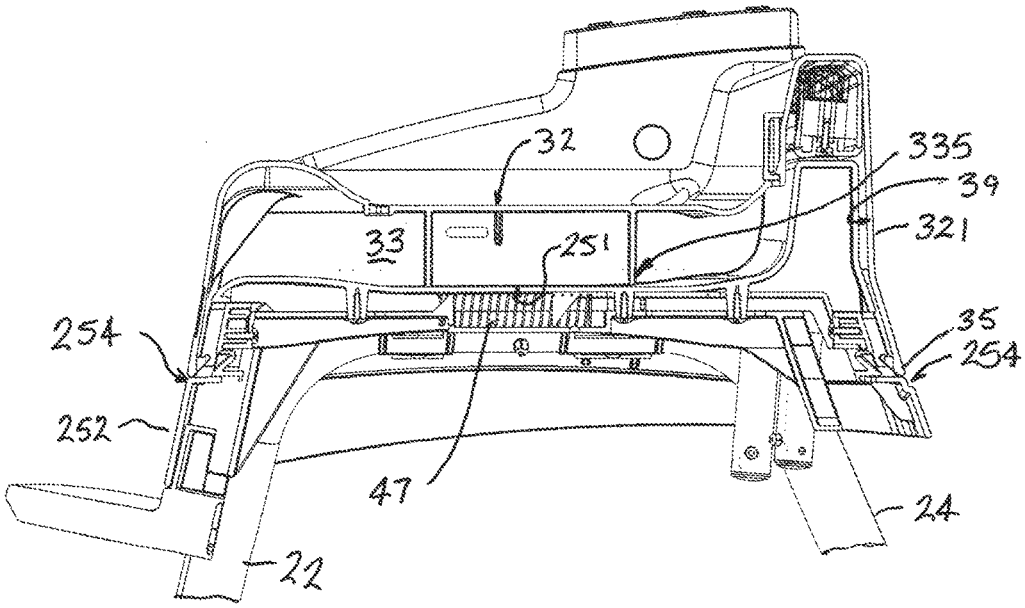
FIG. 6 is a section view of the chair of FIG. 5 wherein the latching mechanism is shown in the unlatched position.
Figure 7:
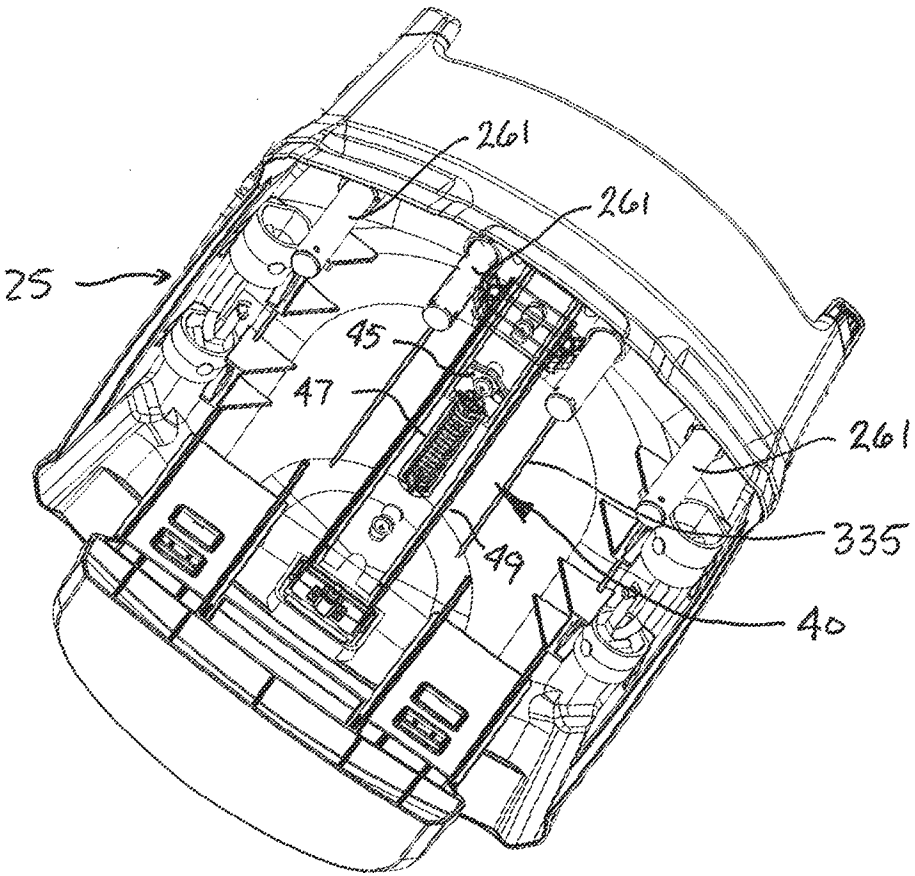
FIGS. 7 and 8 provide an underneath view of the upper seat portion with portions of the structure removed to illustrate the latching mechanism.
Figure 8:
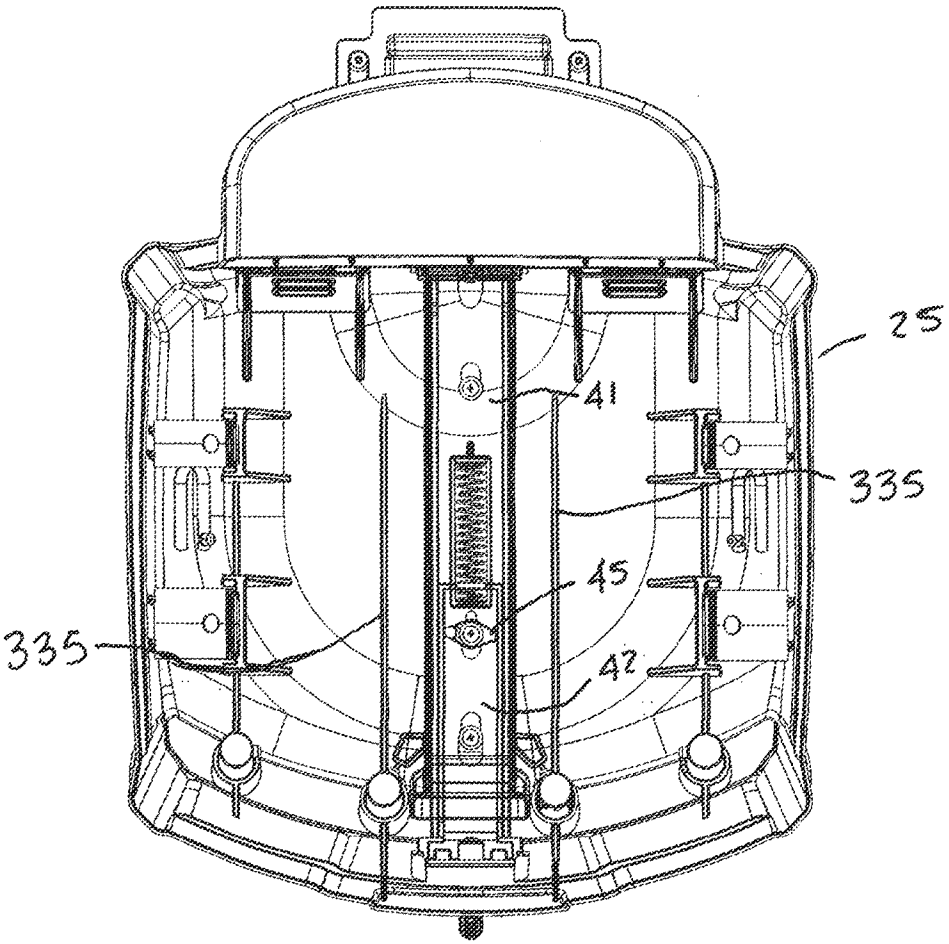
Figure 9:
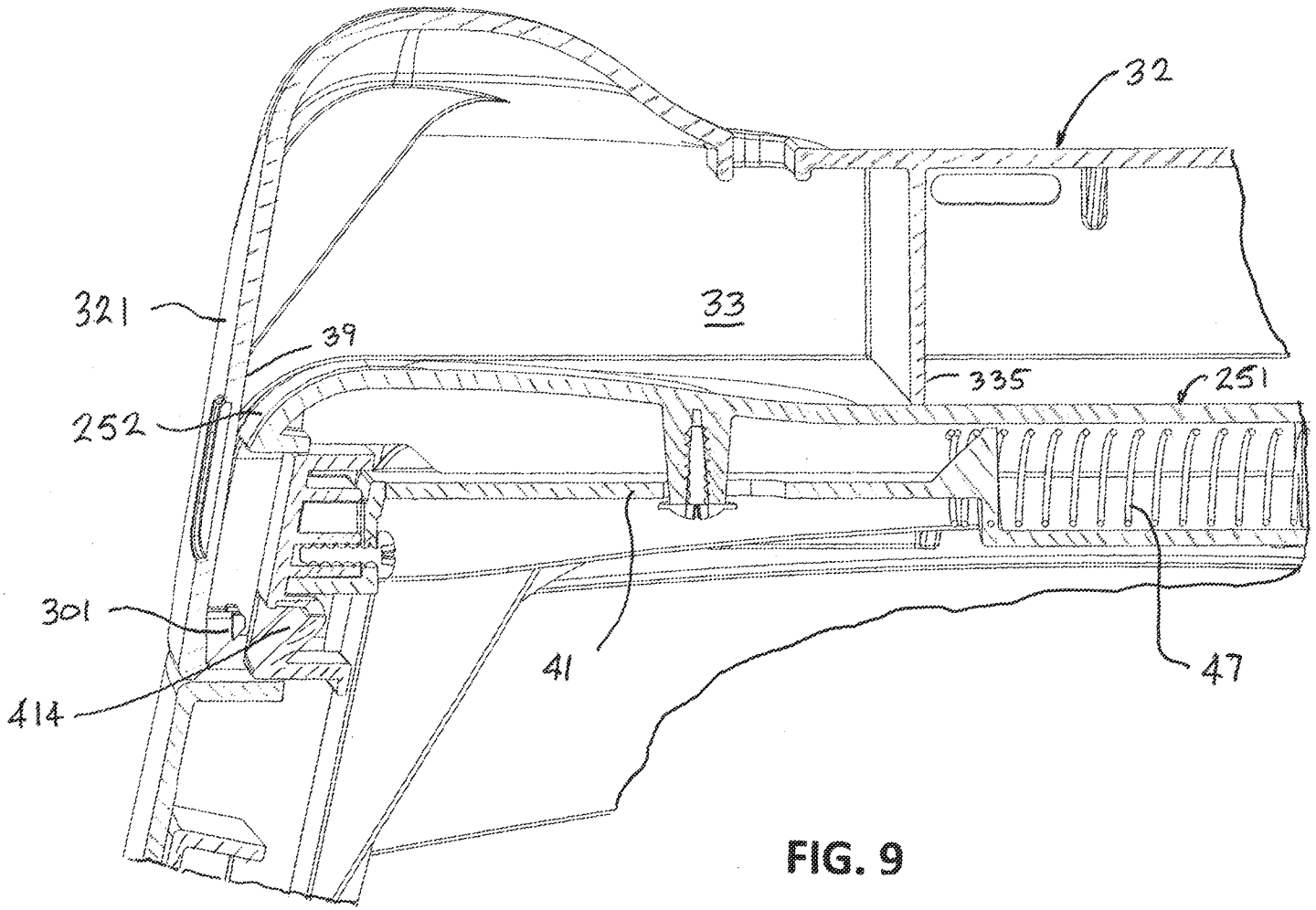
FIGS. 9 through 11 provide additional views of the latching mechanism that retains the booster seat portion to the toddler seat portion.
Figure 10:
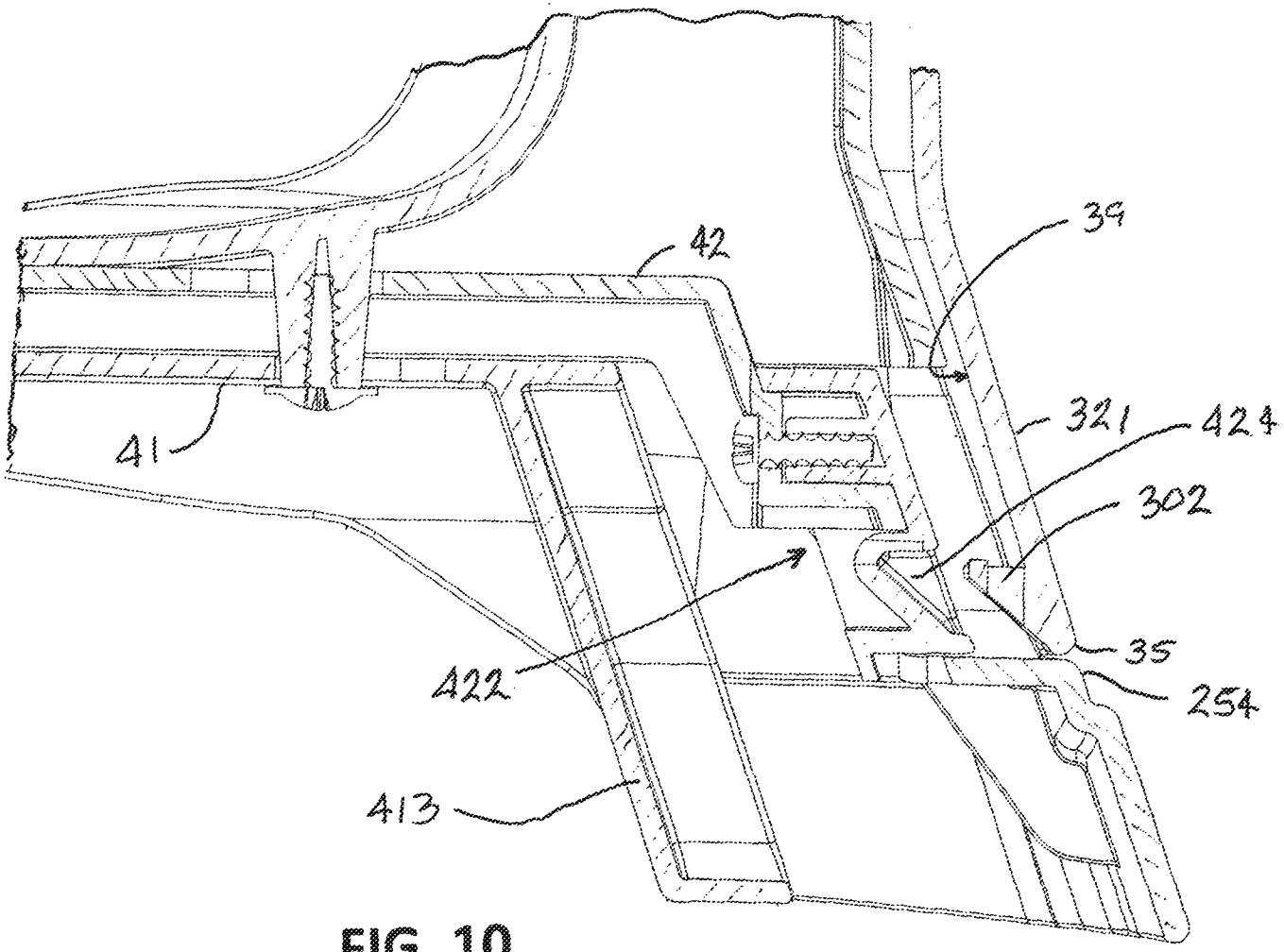

FIGS. 5 and 6 further illustrate the nesting connection between the lower seat portion 20 and the upper seat portion 30 which forms the complete high chair configuration 10. Lateral positioning and stability is established by configuring the exterior surface of the lower seat assembly 25 with upstandingly angled side surfaces 252 that are received in the interior space 33 formed in the lower side of the upper seat portion 30 such that the interior surface 39 of the booster seat portion is adjacent to the angled side surfaces 252. The nesting arrangement is sufficiently snug to preclude appreciable lateral movement of the booster seat portion 30 in relation to the lower seat portion 20. Vertical support of the upper seat portion 30 is provided by support structures 335 within the recessed space configured to rest upon the lower seating surface 251 when the upper seat portion is nestingly positioned to provide a direct path to transfer load on the upper seat 31 to the lower seat assembly 25 and to the support legs 22, 24. Other means for vertical support are envisioned, including converging angles of the angled side surfaces 252 and the interior surface 39 of the upper seat portion or external support structures provided on the lower seat assembly 25 which may support the lower end 35.

Figure 11:
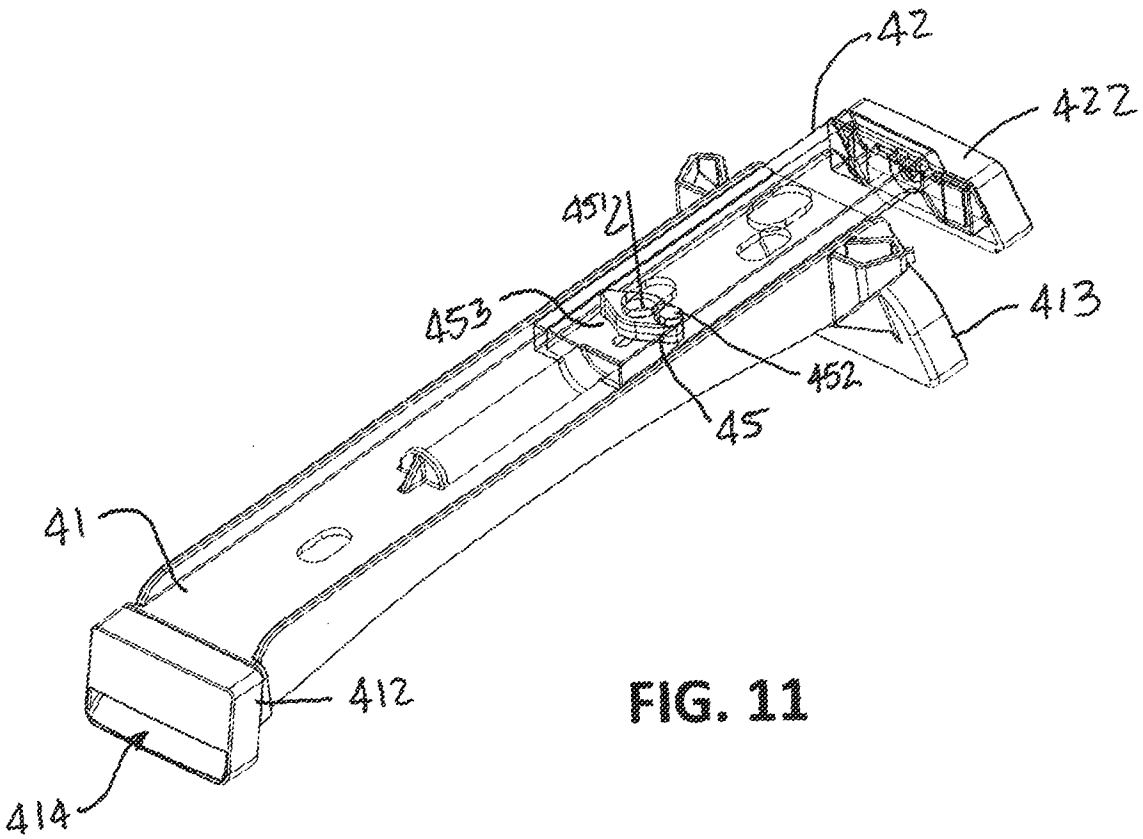

Referring also to FIGS. 7 through 11, the upper seat portion 30 is retained in position atop the lower seat portion 20 by a latching mechanism 40 which engages barbed catch structures 301, 302 formed in the forward and rearward-facing interior surface of the upper seat portion 30. The latching mechanism 40 includes forward and rearward latch spine portions 41, 42 supported in the lower seat assembly 25 for axial movement in a linear track 49 in generally opposing inward and outward directions. A gear or linkage 45 connects the spine portions 41, 42 in a manner such that movement of the respective spine portions is in opposite directions relative to each other. FIG. 11 shows one embodiment in which linkage 45 is configured to rotate about axis 451 that is fixed in relation to the lower seat portion 20. A first lug 452 spaced apart from the axis 451 is linked to one spine portion, rearward spine portion 42 as shown. A second lug 453 positioned on an opposite end from the first lug 452 and an equal distance from the axis 451 is linked to the other spine portion, the forward spine portion 41 as shown. Movement of one spine portion causes the linkage to rotate which, in turn, causes the other spine portion to move in an equal and opposite direction, constrained by the linear track 49. Replacing the linkage 45 with a gear or cog and providing sections of gear rack on each spine portion can accomplish the same result.

There are numerous alternative linkages capable of synchronizing movement of the spine portions 41, 42 to achieve the required simultaneous inward or outward movement of the ends. All such linkages are contemplated within the scope and spirit of the invention.

The respective outward ends 412, 422 of the spine portions each include an angled indentation 414, 424 which receives the respective catch structures 301, 302 when the upper seat portion 30 is engaged on the lower seat assembly 25. The spine portions 41, 42 are spring biased by spring element 47 so that the respective outward ends 412, 422 are normally extended outwardly to engage the catch structures 301, 302. In order to release the latching mechanism 40 to allow booster seat portion 30 to be removed from the lower seat portion 20, an actuator 413 is provided to allow a user to move the latching mechanism 40. The actuator may be connected to either spin portion as the linkage 45 in the latching mechanism 40 causes the simultaneous movement of both spines inwardly, disengaging the angled indentations 414, 424 from the catch structures 301, 302. In a preferred embodiment, the actuator 413 is connected to the forward spine portion 41, but disposed adjacent the rear of the seat assembly for convenient access from the rear of the seat by an adult or caregiver while making access by a child occupant of the chair extremely difficult.

The advantages of the latching mechanism 40 having a single actuator 413 include the capability for a user to release the latch with a single hand operation depressing the actuator 413 inwardly which simultaneously disengages the forward and rearward angled indentations 414, 424 from the respective catch structures 301, 302 and allows upward movement of the booster seat portion 30 and separation from the lower seat portion 20. The latching mechanism may also be used to release the telescoping members 261 and permit movement of the back support 26 between the raised and lowered positions. It is preferable to latch the back support 26 only in the raised position and allow gravity to maintain it in the lowered position such that use of the actuator 413 is only required to lower the back support 26 in preparation to connect the upper seat portion 30.

Figure 12:
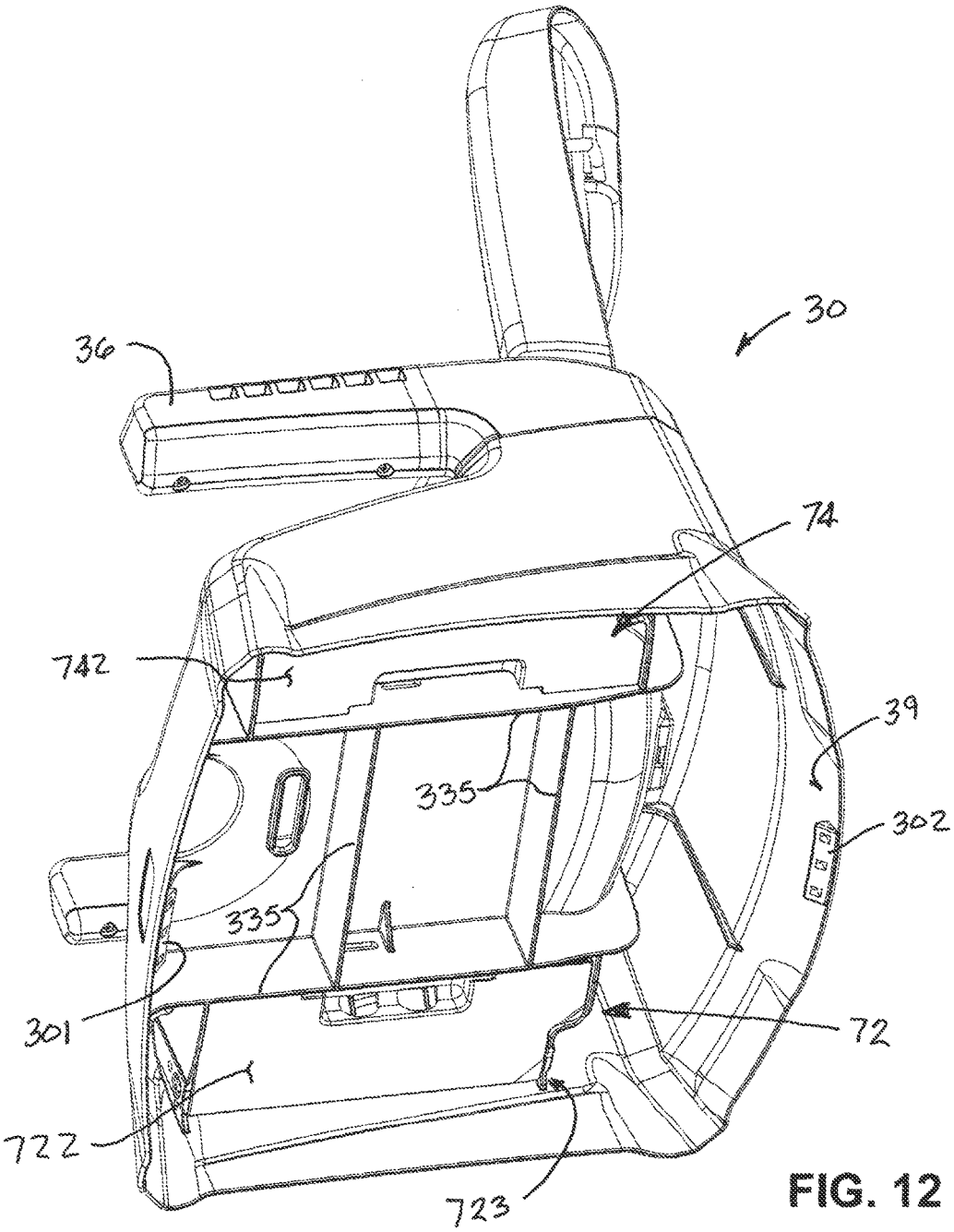
FIGS. 12 and 13 show the support provisions enabling stand-alone use of the upper seat portion as a booster seat.
Figure 13:
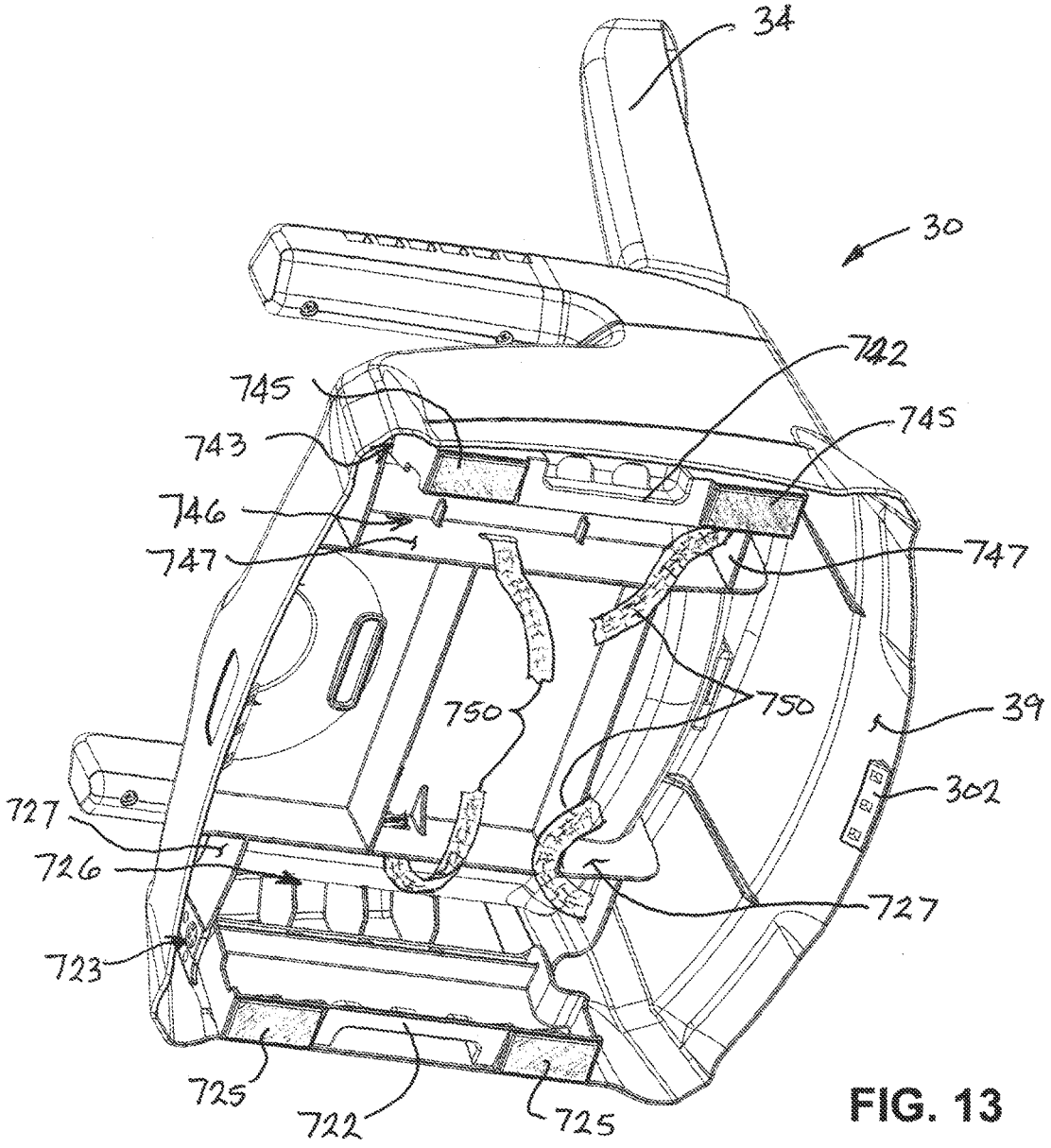

Stand-alone use of the upper seat portion 30 as a booster seat provides (FIG. 3) expands the versatility of the multi-mode high chair 10. Referring to FIGS. 12 and 13, there is illustrated the underside of the upper seat portion 30 showing the interior recessed space 33 also containing right and left side foot structures 72, 74. These structures each include a hinged cover 722, 742 featuring a hinged connector 723, 743 adjacent to an outboard side of the seat portion 20. The hinged covers are pivotable approximately 90 degrees between a closed position, shown in FIG. 12, and an open position, shown in FIG. 13. The hinged covers 724, 744 provide access to a pair of chambers 726, 746 disposed within the recessed space 33 that are separated from the recessed space by chamber walls 727, 747. A plurality of elongate straps 750 attached at one end to the interior surface 39 or chamber walls 727, 747 adjacent each chamber 726, 746 in a manner such that the strap can be folded and stored within respective chambers 726, 746. Positioning the hinged covers 722, 742 in the closed position allows the straps 750 to remain secured and contained within the chambers 726, 746 for periods when the upper seat portion 30 is being used connected to the lower seat portion 20. The chambers 726, 746 and hinged covers 722, 742 are positioned within the interior recessed space 33 to preclude contact with the seating surface 251 or other portions of the seat assembly 25 that might otherwise prevent the upper seat portion 30 from fully nesting on the lower seat assembly 25.

Opening the hinged covers 722, 742 and moving them to the open position (FIG. 13) allows the straps 750 to be removed from the chambers. Support feet 725, 745 disposed on the ends of the of the hinged covers 722, 742 opposite of the hinged connector 723, 743 are repositioned as the covers 722, 742 are moved to the open position so that the upper seat portion 30 will rest on the support feet 725, 745 when the upper seat portion 30 is upstandingly placed on a generally level surface, such as a chair. The support feet 725, 745 may include pads of rubber or similar non-marring material in order to reduce the risk of damage to the chair on which they rest. The straps 750 may be provided with connectors allowing the free ends to be connected and straps adjusted to secure the upper seat portion 30 to another chair thereby allowing the upper seat portion 30 to function as a booster seat apart from use with the lower seat portion 20.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention;

however, concepts, as based upon the description, may be employed in other embodiments without departing from the scope of the invention.

I claim:

1. A multi-mode child's high chair comprising:

a frame having a plurality of upstanding legs;

a first seat portion supported above the floor by a frame, the first seat portion having a lower seat surface peripherally bounded by an angled side wall extending downwardly therefrom and a back support extending upwardly from the lower seat surface;

a second seat portion having an upper seat and a generally opposed recessed surface, the recessed surface defining a generally hollow interior space configured to nestingly receive the back support and at least a portion of the angled side wall, adjacent contact between the recessed surface and the side wall inhibiting relative lateral movement between the first and second seat portions;

a forward and a rearward catch oppositely disposed on the recessed surface;

a latching mechanism having a forward and a rearward latch disposed on the first seat portion, the forward and rearward latches being selectively moveable between generally opposing first and second positions, the forward and rearward latches engaging the forward and rearward catches, respectively, when the second seat portion is nestingly positioned on the lower seating surface and the latches are in the first position preventing separation of the second seat portion from the first seat portion, movement of the latches to the second position enabling the second seat portion to be separated from the first seat portion; and a linkage connecting the forward and rearward latches enabling the latches to simultaneously move between the first and second positions.

2. The high chair as described in claim 1, wherein the second seat portion includes a lower end defining a periphery of the second seat portion that is configured to match the angled side wall of the first seat portion periphery, and a support structure disposed within the interior space to contact the lower seat and vertically support the second seat portion when the second seat portion is nestingly positioned on the lower seat.

3. The high chair as described in claim 2, wherein the forward and rearward latches each comprise an elongate member having a distal end and a proximal end, each elongate member having an engaging structure disposed at the distal end.

4. The high chair as described in claim 3, wherein the elongate members are each movable along a linear track and the linkage causes movement of the elongate members along the track and simultaneous movement of the latches toward their respective first or second positions.

5. The high chair as described in claim 4, wherein the latching mechanism includes a handle enabling single-handed movement of the forward and rearward latches, and a biasing mechanism for urging the forward and rearward latches toward the first position.

6. The high chair as described in claim 1, wherein the forward and rearward catches each include an angled projection extending inwardly into the interior space and the forward and rearward latches each include an angled indentation for receiving the respective angled projections, the angled projections and the angled indentations configured as a ratchet inhibiting uplift of the second seat portion from the first seat portion when the latches and catches are engaged.

7. The high chair as described in claim 1, further comprising a backrest extensible from the lower seating surface, the backrest being positionable in at least a raised position and a lowered position, the backrest preventing nesting positioning of the second seat portion when in the raised position and permitting the nesting positioning of the second seat portion and engagement of the latches in the receptacles when in the lowered position.

8. The high chair as described in claim 7, wherein the backrest includes at least one telescoping member enabling movement of the backrest between the raised and lowered positions.

9. The high chair as described in claim 8, wherein the latching mechanism is configured to maintain the backrest in the raised position when in the first position and to permit movement of the backrest to the lowered positon when moved to the second position.

10. The high chair as described in claim 1, wherein the upper seat portion further comprises a pair of spaced-apart foot structures disposed within the interior space, each foot structure having a cover hingedly movable between an open and a close position, each cover having a foot disposed along an edge opposite of the hinge, each foot positioned to support the upper seat portion on a generally level surface when the cover is in the open position, each foot being positioned within the interior space to permit nesting positioning of the upper seat portion on the lower seat portion when in the closed position.

11. The high chair as described in claim 10, wherein each foot structure further comprises a chamber formed in the recessed surface, the chamber being accessibly enclosed by the cover, and an elongate strap secured at one end to the recessed surface, each strap being storable in the respective chamber and removeable when the respective covers are in the open position to secure the upper seat portion to the generally level surface.

12. The high chair as described in claim 11, wherein each cover pivots approximately 90 degrees when moving between the open and closed positions.

13. A convertible seat for a child comprising:

a first seat portion having a lower seat supported above a floor by a frame;

a backrest extensible from the lower seating surface, the backrest being moveable between a raised position and a lowered position;

a second seat portion having an upper seat and a generally opposed recessed surface, the recessed surface defining an interior space configured to nestingly engage the backrest in the lowered position and a portion of the lower seat in a manner inhibiting relative lateral movement therebetween, positioning the backrest in the raised position inhibits nesting engagement of the second seat portion on the first seat portion;

a latch mechanism for releaseably securing the second seat portion to the first seat portion in at least two locations when the second seat portion is nestingly engaged on the first seat portion; and an actuator enabling simultaneous release of the at least two locations of the latch mechanism.

14. The seat as described in claim 13, wherein the first seat portion includes an upstandingly angled side wall partially extending around a periphery of the first seat portion and the second seat portion includes a lower end defining a periphery of the second seat portion configured to match the first seat portion periphery, and a support structure disposed within the interior space to contact the lower seat and vertically support the second seat portion when the second seat portion is nestingly positioned on the lower seat.

15. The seat as described in claim 14, wherein the upper seat portion further comprises a pair of spaced-apart foot structures disposed within the interior space, each foot structure being moveable between an open and a closed position, each foot structure positioned to support the upper seat portion on a generally level surface when the foot structure is in the open position, each foot structure being positioned within the interior space to permit nesting positioning of the upper seat portion on the lower seat portion when in the closed position.

16. The seat as described in claim 15, wherein each foot structure comprises a cover hingedly movable between generally opposing first and second positions corresponding to then open and close positions, each cover having a foot disposed along an edge opposite of the hinge, each foot positioned to support the upper seat portion on a generally level surface when the cover is in the open position, each foot being positioned within the interior space to permit nesting positioning of the upper seat portion on the lower seat portion when in the closed position.

17. The seat as described in claim 16, wherein the foot structure pivots approximately 90 degrees when moving between the open and closed positions.

18. The seat as described in claim 15, wherein each foot structure further comprises a chamber formed in the recessed surface, the chamber being accessibly enclosed by the cover, and an elongate strap secured at one end to the recessed surface, each strap being storable in the respective chamber and removeable when the respective covers are in the open position to secure the upper seat portion to the generally level surface.

19. The seat as described in claim 14, wherein the latch mechanism further comprises:

a pair of catches disposed on the second seat portion;

forward and rearward latches disposed on the first seat portion, the forward and rearward latches each being selectively moveable between first and second positions and positionable to permit engaging of one of the pair of catches, respectively, when the second seat portion is atop the first seat portion and the latches are in the first position, engagement of the latches and catches preventing separation of the second seat portion from the first seat portion, movement of the latches to the second position enabling the second seat portion to be separated from the first seat portion;

a linkage connecting the forward and rearward latches causing simultaneous movement thereof; and a biasing mechanism for urging the forward and rearward latches toward the first position.

20. The seat as described in claim 19, wherein the latch mechanism includes a handle enabling single-handed movement of the forward and rearward latches.

21. The seat as described in claim 13, wherein the backrest includes at least one telescoping member enabling movement of the backrest between the raised and lowered positions.

22. The seat as described in claim 21, wherein the latching mechanism is further configured to maintain the backrest in the raised position when in the first position and to permit movement of the backrest to the lowered positon when moved to the second position.

* * * * *